United States Patent [19]

Waldo et al.

[11] Patent Number: 4,570,985

[45] Date of Patent: Feb. 18, 1986

[54] LOCKING APPARATUS FOR USE WITH A PANEL SLIDEABLE IN A PLANE

[75] Inventors: Russell W. Waldo, Mendota Heights, Minn.; Cardell E. Miller, Hudson, Wis.; Louis D. Huot, Vadnais Heights; George L. Engstrom, Minneapolis, both of Minn.

[73] Assignee: Ideal Security Hardward Corporation, St. Paul, Minn.

[21] Appl. No.: 371,309

[22] Filed: Apr. 23, 1982

[51] Int. Cl.[4] ..... E05C 17/30

[52] U.S. Cl. ..... 292/262; 49/449; 292/DIG. 46

[58] Field of Search ..... 292/306, 262, 338, 339, 292/DIG. 46; 49/449

[56] References Cited

U.S. PATENT DOCUMENTS

| | | | |
|---|---|---|---|
| 3,328,920 | 7/1967 | Cohen et al. | 49/449 |
| 3,480,247 | 11/1969 | Waner | 292/306 X |
| 3,615,114 | 10/1971 | Harris | 292/306 X |
| 3,821,884 | 7/1974 | Walsh | 65/8 |
| 4,005,889 | 2/1977 | Patrick | 292/262 |
| 4,135,376 | 1/1979 | Evans et al. | 70/370 |
| 4,295,676 | 10/1981 | Smith | 292/262 |
| 4,314,721 | 2/1982 | Clark | 292/262 |

*Primary Examiner*—Richard E. Moore

*Attorney, Agent, or Firm*—Merchant, Gould, Smith, Edell, Welter & Schmidt

[57] ABSTRACT

A locking bar (3) for use with a slideable panel (9), for example, sliding glass patio doors. The bar (3) includes first and second telescoping members (14 and 15) and a locking mechanism (16) at the point of attachment of the two members. The first member (14) is fixed against movement toward and away from the second member (15). The second member (15) is capable of telescoping movement relative to the first member (14). The locking bar further includes a bracket (19) for holding the second member (15) against movement relative to the slideable panel (9).

6 Claims, 6 Drawing Figures

FIG. 1
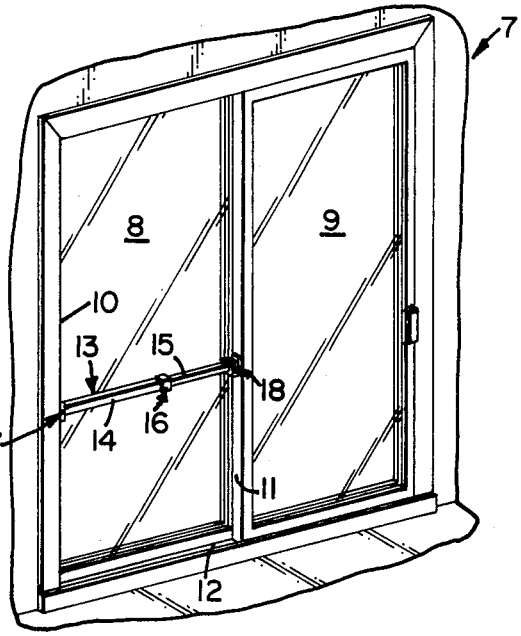
FIG. 2
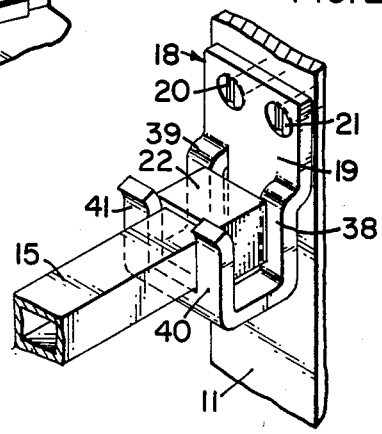
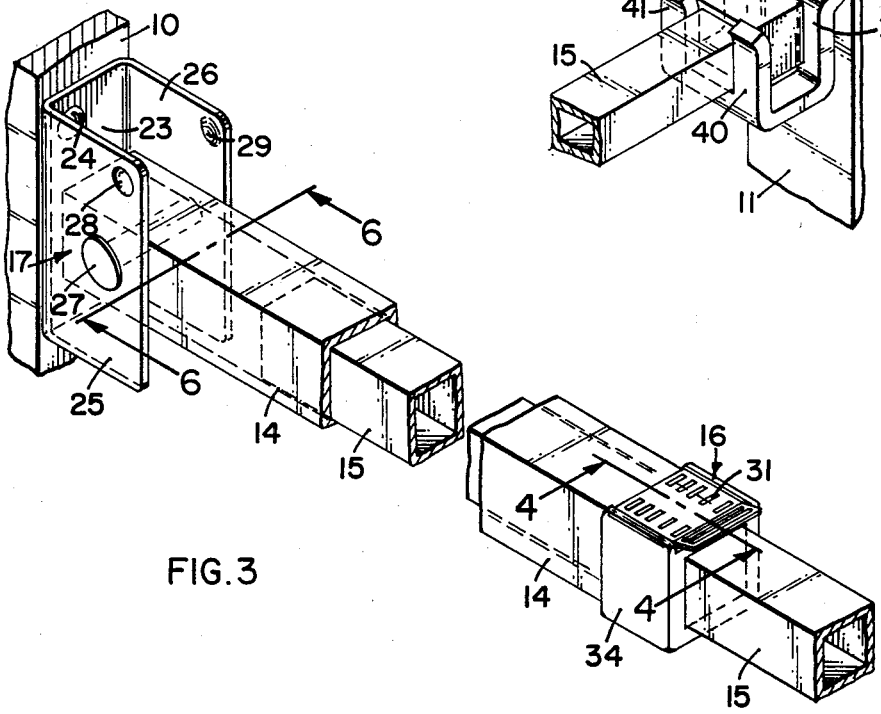
FIG. 3

FIG. 4
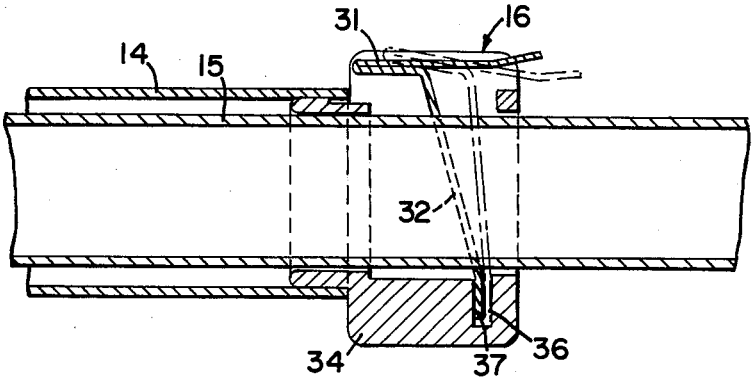
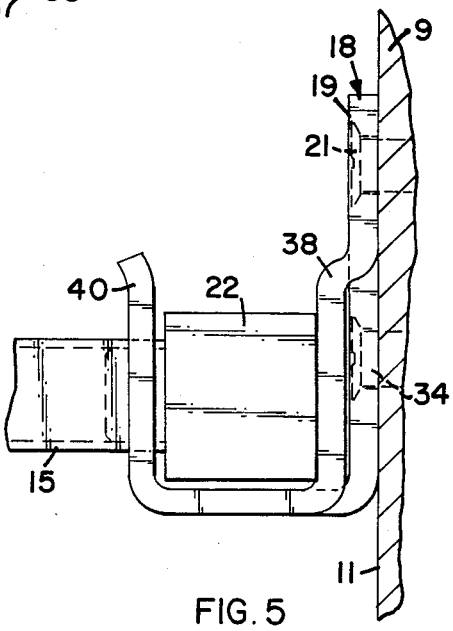
FIG. 5
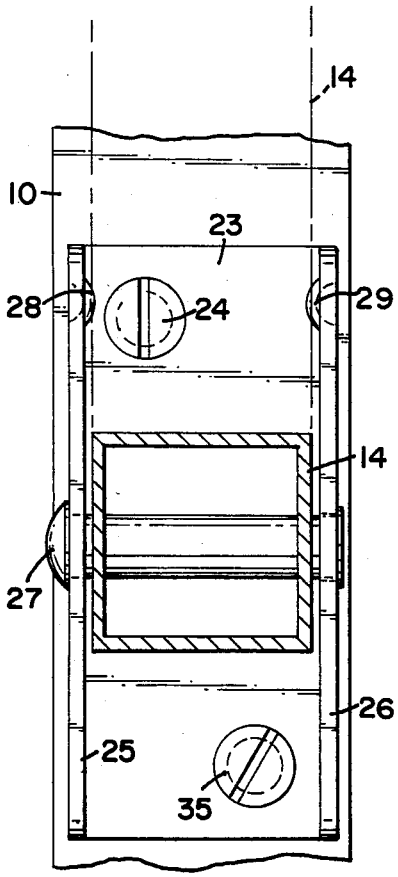
FIG. 6

LOCKING APPARATUS FOR USE WITH A PANEL SLIDEABLE IN A PLANE

FIELD OF THE INVENTION

This invention relates to a locking apparatus for use with a panel slideable in a plane. More particularly, this invention relates to a locking apparatus for a pair of panels such as sliding glass doors installed as a wall closure where one panel slides in a plane adjacent and parallel to one panel which is fixed. In a preferred embodiment the locking apparatus comprises two slideably attached members and a locking mechanism which prevents movement, in one direction only, of one of the two members relative to the other member.

BACKGROUND OF THE INVENTION

"Sliding glass doors" or "sliding doors" are terms commonly used for wall closures comprising a pair of generally transparent panels where one panel is fixed adjacent to a surface such as a wall or door jamb and the other panel is slideable in a track parallel and adjacent to the fixed panel. The doors are considered "closed" when the slideable panel has been moved as far as possible along the track in a direction away from the fixed panel and abuts the wall wherein the panels are set. In the closed position the panels generally overlap somewhat and form a substantially continuous surface with the wall. The doors are "open" to various degrees or "partially closed" when the slideable panel is anywhere along the track other than in the position where it abuts the wall away from the fixed panel, and the panels no longer form a continuous surface with the wall.

Such sliding panel pairs generally comprise one of two types. A first type is known as an inside-sliding door. This type of pair is one wherein the fixed panel defines a plane closer to the outside of the building in a wall of which the panel/jamb assembly is mounted. The plane defined by the sliding panel is closer to the inside of the building.

The second type of assembly is referred to as an outside-sliding door. In this assembly, the fixed panel defines a plane closer to the inside of the building. Conversely, the sliding panel defines a plane closer to the outside of the building.

Locks for panels such as sliding glass doors are frequently located in the door frame or wall edge which contacts the slideable panel when the doors are closed. Many of these locks do not provide positive locking and can be broken by leverage. Therefore, another style of lock is also commonly used particularly in the case of inside sliding door panels. This style comprises a bar or rod, for example, a broom handle, placed in the track when the doors are closed. By blocking the track, the bar can prevent the sliding door from sliding open. This type of lock is not subject to being broken by leverage. However, this bar type lock can be inconvenient because it generally requires stooping to place it correctly in the track or to remove it. Further, it can be difficult to guide it into the track or to lift it from the track because the track can be narrow. A further problem with this bar type lock is that the length of the bar will determine the only possible position at which the door can be locked, for example, fully closed.

Another type of locking bar for sliding doors is exemplified by U.S. Pat. No. 3,328,920 (Cohen). This type of locking bar can be pivotally mounted on the door jamb abutting the fixed panel. When the sliding glass doors are to be locked closed, the bar can be swung into position across the fixed panel and held against the edge of the slideable panel, thus preventing the panel from sliding and the door from opening. When the door is to be opened, the bar is swung up away from the edge of the slideable panel into a position next to the door jamb which abuts the fixed panel, allowing the slideable panel to slide freely in its track. With this type of locking bar, the doors can only be locked in a single, non-variable position, for example, fully closed. If it is desirable to leave the door open somewhat, even only slightly, the locking bar will be of no use to prevent further opening of the door.

The present invention provides a locking apparatus for both inside and outside sliding doors which can be free from breakage by leverage. Additionally, the locking apparatus can accomodate the panel in an infinite number of positions ranging from partially closed to fully closed.

The lock can be convenient and easy to use. If the panel is locked in a partially closed position, the locking apparatus can prevent further opening of the panel, while freely allowing the panel to slide to a more closed position. If the panel is moved to a more closed position while the locking bar is in place, the bar will automatically lock the panel in the new position.

The panel can be moved to a more open position while the bar is in place if a release member on the bar is activated. Again, when the panel has reached the desired position, the bar will automatically lock it at that point.

SUMMARY OF THE INVENTION

The present invention is a locking apparatus for use with a panel slideable in a plane. The apparatus includes two slideably attached members. The first of the two members or first member is fixed against movement in the directions in which the panel slides, and a second of the members or second member is disposed for reciprocal sliding movement relative to the first member. The apparatus also includes a locking mechanism located at the point of attachment of the two members. This locking mechanism locks the second member against movement relative to the first member in one direction only, that same direction against which the locking apparatus prevents the panel from moving. The apparatus further includes means for holding a remote end of the second member against movement relative to the slideable panel.

The locking apparatus can be used with the panel in at least two ways, either locking the panel against sliding in the open direction, or locking the panel against sliding in the closed direction. Generally, as in the preferred embodiment, the locking apparatus will be installed to lock the panel against sliding in the open direction. In the preferred embodiment, the panel can be locked in a fully closed position or in any partially closed position up to where the bar is compressed to its minimum length. When the bar is in place it will prevent the panel from sliding in the open direction unless a release member is activated. However, the bar will allow the panel to slide to a more fully closed position and be locked at that point by merely sliding the panel as one normally would even without the locking bar. Other advantages of this invention will become apparent with reference to the accompanying Drawings, detailed description of the invention, and claims.

BRIEF DESCRIPTION OF THE DRAWINGS

FIG. 1 is a perspective view showing a preferred embodiment and installation of the locking apparatus with the locking apparatus in place, preventing the slideable panel from sliding in the open direction.

FIG. 2 is a perspective view showing a preferred means for attaching a remote end of the second member to the slideable panel.

FIG. 3 is a fragmentary view in perspective showing a preferred means for pivotally attaching a remote end of the first member to a door jamb abutting a fixed panel.

FIG. 4 is a view taken generally along line 4—4 of FIG. 3.

FIG. 5 is an enlarged fragmentary view of a preferred means for attaching a remote end of the second member to the slideable panel.

FIG. 6 is a view taken generally along line 6—6 of FIG. 3.

DETAILED DESCRIPTION OF THE INVENTION

Referring now to the Drawings wherein like reference numerals denote like elements throughout the several views, FIG. 1 illustrates a perspective view of the sliding panel assembly 7 comprising a fixed panel 8 and a slideable panel 9. The pair of panels 8, 9 are shown in an inside-sliding door configuration. Further illustrated are the door jamb 10 adjacent to the fixed panel, the inner edge 11 of the slideable panel, and the track 12 in which the slideable panel moves parallel to the fixed panel, toward and away from it. The locking apparatus or locking bar 13 is shown in the locked or operative position.

The locking apparatus 13 can comprise two slideably attached members (first member 14 and a second member 15), a locking mechanism 16, a means 17 for pivotally attaching a remote end of first member 14 to the door jamb 10, and means 18 for holding a remote end of second member 15 against the slideable panel 9.

The two slideably attached members can comprise a first member 14 which is fixed against movement along track 12 in directions toward and away from fixed panel 8. The second member 15 is capable of sliding movement in a direction toward and away from the first member 14 and will generally remain attached to it.

Preferably the members will telescope relative to one another, as illustrated in FIGS. 3 and 4. In the Drawings, the second member 15 is shown as capable of sliding movement into and out of the fixed or first member 14. It is also envisioned that the second member could slide on the outside of the fixed of first member.

The locking mechanism 16 is illustrated in FIG. 3 at the point where members 14 and 15 are slideably attached, and can be carried by an end of first member 14. The mechanism locks the second member against movement relative to the first member in one direction only. As shown in FIG. 4, the mechanism can comprise a locking member 32 which engages one of the slideably attached members with a direction of force preventing movement of the second member relative to the first member in the one direction. The locking mechanism 16 can further comprise release member 31, which can be connected to the locking member 32. The release member can be activated to disengage the locking member 32 from the slideably attached member. The disengagement can allow the second member to freely slide in a direction toward and away from the first member.

Describing a preferred embodiment of the locking mechanism in more detail, second member 15 slides through the locking mechanism into and out of first member 14. The locking mechanism comprises a lock housing 34 attached to an end of first member 14. Lock housing 34 and the release member or manual release tab 31 together form a box-like shape defining the outer surfaces of locking mechanism 16. Manual release tab 31 which forms one side of the locking mechanism extends down along the sides of second member 15 as a sheet-like locking member 32 at an angle to the second member, contacting or engaging the top surface of the second member at an angle and with a direction of force which prevents the second member from sliding into first member 14. Activation of release member 31 can cause the locking member to disengage the second member for free movement into and out of first member 15.

Locking member 32 fits into a slot 36 along the bottom of lock housing 34. A leaf spring 37 biases sheet-like locking member 32 to aid in maintaining the locking member at the proper angle.

Generally, the direction in which the locking mechanism 16 will prevent the second member from moving will be the direction toward the first member (compression of the locking bar). At the same time, the mechanism 16 will permit movement of the second member in the opposite direction away from the first member (expansion of the bar). It is also envisioned that the bar can be locked against expansion while being freely allowed to compress.

The means 17 for pivotally attaching a remote end of first member 14 to the door jamb 10 can comprise a bracket 23 for mounting on the jamb in the case of an inside-sliding door configuration. The bracket can comprise at least one arm and a pivot pin 27 which passes through at least one arm and through the remote end of the first member 14.

As illustrated in FIG. 3, a preferred means 17 for pivotally holding first member 14 against the door jamb 10 comprises the bracket 23 attached to the jamb by screws 24 and 35 (shown in FIG. 6 only). The bracket comprises two substantially parallel arms 25 and 26 extending outwardly from the door jamb 10. One arm is proximate either end of a pivot pin 27. The pivot pin extends through the arms 25 and 26 and through a remote end of first member 14 which is located between them.

In other embodiments, the bracket can be of a type without arms or can comprise a single arm or more than two arms not necessarily parallel. It is also envisioned that the bracket need not be mounted on the jamb 10, but can be mounted elsewhere. For example, the bracket can be mounted on another surface adjacent to the fixed panel, such as a wall or ceiling.

This invention can further comprise means for holding the slideably attached members in an inoperative position (a position which will not lock the panel from moving in either the open or closed directions). The holding means can comprise at least one detent protruding from an inside surface of at least one of the arms extending from bracket 23, for frictionally holding first and second members 14 and 15 in an inoperative position substantially parallel to the jamb.

In the preferred embodiment illustrated in FIG. 3, detents 28 and 29 are located on the upper portion of arms 25 and 26. The detents protrude inwardly between the arms for frictionally holding the members 14 and 15 in an a position substantially parallel to jamb 10. Other holding means could be used to hold the members in an inoperative position. Such means can include structures such as magnets, Velcro-type materials, a detent or detents which engage depresions in the surface of the first member, and the like. The detents can be spring-loaded and the like.

Means 18 for holding a remote end of second member 15 against movement relative to the slideable panel can comprise a bracket 19 for mounting on the slideable panel and for holding the remote end of the second member.

The means 18 can further comprise a larger end portion on the remote end of second member 15 which engages the bracket 19 and prevents the second member from being removed from the bracket by the force of the slideable panel sliding toward or away from the fixed panel.

FIG. 2 is an enlarged view of a preferred means 18 for holding a remote end of the second member against movement relative to slideable panel 9. The bracket, in the case of an inside-sliding door, is attached to the inner edge 11 of the slideable panel 9 by screws 20, 21, and 34 (shown in FIG. 5 only).

Bracket 19 can comprise shoulders 38 and 39 which can be raised from the bracket and parallel, in the inside-sliding door configuration, to edge 11 of the slideable panel. Bracket 19 can further comprise prongs 40 and 41 which can be essentially parallel to the shoulders and spaced at a distance from the shoulders in a direction away from the bracket. The shoulders and prongs can capture larger end portion 22 of member 15 therebetween to prevent the withdrawal of the member from the bracket 19 when panel 9 slides.

When the locking bar is in place across a panel as illustrated in FIG. 1 and it is desired to remove the bar, members 14 and 15 can be pivoted upwardly out of bracket 19, away from sliding panel 9, and into the grasp of detents 28 and 29, as shown in phantom in FIG. 6. The locking bar thus assumes an inoperative or non-locking position.

When it is desired to use the locking apparatus in its operative position, members 14 and 15 are merely pivoted downwardly out of the grasp of the detents and away from door jamb 10 to a substantially horizontal position. Members 14 and 15 are telescoped as necessary to stretch across the bracket 19, and larger end portion 22 is placed into bracket 19 as shown in FIGS. 2 and 5.

In the case of an outside-sliding door configuration, an edge (not shown) of the fixed panel 8 will be exposed to a person inside the building, in a wall of which the panels 8, 9 are mounted. Bracket 23 can be mounted to this edge and members 14, 15 pivotally disposed relative to the bracket 23 so that they can be swung into a generally horizontal position.

Since, in this configuration, edge 11 of panel 9 would not be exposed, bracket 19 can be mounted to the frame of panel 9 facing inwardly into the building. This is essentially pivoting the bracket 19 ninety degrees relative to its orientation when it is used in an inside-sliding door configuration.

With bracket 19 thusly positioned, member 15 and its enlarged end portion 22 can be received between prong 41 and shoulder 39 rather than between prongs 40, 41. As panel 9 is moved toward a closed position, therefore, bracket 19 will draw member 15 to its extended position to lock panel 9 closed. In this configuration, operation of locking mechanism 16 remains the same as in the inside-sliding door panel configuration. As can be seen, the locking apparatus of this invention can be used with either an inside-sliding door configuration or an outside-sliding door configuration, without any modification to the apparatus itself.

Numerous characteristics and advantages of this invention have been set forth in the foregoing detailed description. It will be understood, of course, that this disclosure is, in many respects, only illustrative. Changes may be made in details, particularly in matters of shape, size, and arrangement of parts without exceeding the scope of the invention. Since persons skilled in the art can make various embodiments without departing from the spirit and scope of the invention, the invention is embodied in the claims hereinafter appended.

What is claimed is:

1. A lockable panel combination comprising:

(a) a pair of panels wherein one panel is fixed adjacent to a surface and the other panel is slideable in a plane adjacent and parallel to the fixed panel, the slideable panel being suitable for selectively and adjustably sliding in an open direction and a closed direction to provide a variable opening in the surface; and (b) a locking apparatus comprising:

(i) a locking bar mechanism having an adjustable bar length comprising a first member; a second member slideably attached to the first member; and a locking mechanism at the point of attachment of the first and second members, the locking mechanism substantially preventing a decrease in the bar length unless the locking mechanism is activated, and the locking mechanism freely allowing an increase in the bar length;

(ii) first means for operatively connecting a remote end of the first member to the surface; and (iii) second means for operatively connecting a remote end of the second member to the slideable panel, wherein when the locking apparatus is operatively connected to the slideable panel and the surface, the slideable panel can be freely slid in the closed direction but cannot be slid in the open direction unless the locking mechanism is activated;

(iv) the means for connecting a remote end of the first member to the surface comprising a bracket for mounting on the surface;

(v) the remote end of the first member being pivotally attached to the bracket for mounting on the surface, said bracket having at least one arm and a pivot pin which passes through at least one arm and through the remote end of the first member; and (vi) means for holding the slideably attached members in an inoperative position.

2. A lockable panel combination comrpising:

(a) a pair of panels wherein one panel is fixed adjacent to a surface and the other panel is slideable in a plane adjacent and parallel to the fixed panel, the slideable panel being suitable for selectively and adjustably sliding in an open direction and a closed direction to provide a variable opening in the surfaces; and (b) a locking apparatus comprising"

(i) a locking bar mechanism having an adjustble bar length comprising a first member; a second member slideably attached to the first member; and a locking mechanism at the point of attachment of the first and second members, the locking mechanism substantially preventing a decrease in the bar length unless the locking mechanism is activated, and the locking mechanism freely allowing an increase in the bar length;

(ii) first means for operatively connecting a remote end of the first member to the surface;

(iii) second means for operatively connecting a remote end of the second member to the slideable panel, wherein when the locking apparatus is operatively connected to the slideable panel and the surface, the slideable panel can be freely slid in the closed direction but cannot be slid in the open direction unless the locking mechanism is activated; and (iv) the second means for connecting the second member to the slideable panel comprises a bracket for mounting on the slideable panel and for holding a remote end of the second member and wherein the second member connecting means further comprises a larger end portion on the remote end of the second member which engages the bracket and prevents the second member from being removed from the bracket by the force of the slideable panel sliding toward or away from the fixed panel.

3. A lockable panel combination comprising:

(a) a pair of panels installed as a wall closure wherein one panel is fixed adjacent to a jamb and the other panel is slideable in a plane adjacent and parallel to the fixed panel; and (b) a locking bar comprising:

(i) two telescoping members;

(ii) a locking mechanism at the point of intersection of the two members which locks the second member against telescoping into the first member but which permits telescoping of the second member out of the first member;

(iii) means for pivotally attaching the first member with the jamb adjacent to the fixed panel, comprising a bracket for mounting on the jamb, said bracket having two substantially parallel arms and a pivot pin extending perpendicularly through the arms and through the remote end of the first member located between the arms; and (iv) means for attaching the second member to the slideable panel, wherein the means comprises a bracket for mounting on the slideable panel and for holding the second member, and a larger end portion at a remote end of the second member, wherein the larger end portion can engage the bracket thereby preventing the second member from being removed from the bracket by the force of the slideable panel sliding toward or away from the fixed panel.

4. The combination of claim 1 wherein the bracket for mounting on the surface comprises two substantially parallel arms, one proximate either end of the pivot pin, and which further comprises means for holding the slideably attached members in an inoperative position, said holding means comprising at least one detent protruding from an inside surface of at least one of the substantially parallel arms.

5. A locking bar, for use with a pair of panels installed as a wall closure wherein one panel is fixed adjacent to a jamb and the other panel is slideable in a plane adjacent and parallel to the fixed panel, which comprises:

(a) two telescoping members;

(b) a locking mechanism at the point of intersection of the two members which locks the second member against telescoping into the first member but which permits telescoping of the second member out of the first member;

(c) means for pivotally attaching the first member with a jamb adjacent to a fixed panel, comprising a bracket for mounting on a jamb, said bracket having two substantially parallel arms and a pivot pin extending perpendicularly through the arms and through the remote end of the first member located between the arms; and (d) means for attaching the second member to a slideable panel, wherein the means comprises a bracket for mounting on a slideable panel and for holding the second member, and a larger end portion at a remote end of the second member, wherein the larger end portion can engage the bracket thereby preventing the second member from being removed from the bracket by the force of a slideable panel sliding toward or away from a fixed panel.

6. The combination of claim 3 which further comprises means for holding the telescoping members in a position substantially parallel to the jamb, comprising at least one detent located on the inside surface of at least one one of the two substantially parallel arms of the bracket for mounting on the jamb.

* * * * *

UNITED STATES PATENT AND TRADEMARK OFFICE

CERTIFICATE OF CORRECTION

PATENT NO. : 4,570,985

DATED : February 18, 1986

INVENTOR(S) : Russell W. Waldo et al

It is certified that error appears in the above-identified patent and that said Letters Patent is hereby corrected as shown below:

Column 6, line 38, delete "and".

Column 6, line 58, delete "comrprising" and insert --comprising--.

Column 6, line 66, delete " " " and insert --:--.

Column 6, line 67, replace "adjustble" with --adjustable--.

Column 8, delete lines 12 and 13.

Signed and Sealed this

*Twenty-seventh* Day of *May 1986*

[SEAL]

*Attest:*

DONALD J. QUIGG

*Attesting Officer*

*Commissioner of Patents and Trademarks*